US005586656A

United States Patent [19]

Abrums

[11] Patent Number: 5,586,656

[45] Date of Patent: Dec. 24, 1996

[54] NESTABLE AND STACKABLE STORAGE UNIT

[76] Inventor: Rolin L. Abrums, 4243 White Sands Dr., Las Vegas, Nev. 89121

[21] Appl. No.: 372,098

[22] Filed: Jan. 13, 1995

[51] Int. Cl.[6] ..... B65D 21/036

[52] U.S. Cl. ..... 206/501; 206/514; 220/212; 220/4.27; 220/23.86

[58] Field of Search ..... 206/514, 508, 206/509, 501; 220/212, 23.83, 23.86, 4.27, 355, 356, 357, 352

[56] References Cited

U.S. PATENT DOCUMENTS

| | | | |
|---|---|---|---|
| D. 274,696 | 7/1984 | Marsden . | |
| 2,298,814 | 10/1942 | Weis . | |
| 2,429,958 | 10/1947 | Liebmann . | |
| 3,091,361 | 5/1963 | Gawron . | |
| 3,107,028 | 10/1963 | De Robertis | 220/212 |
| 3,474,928 | 10/1969 | Hurtt . | |
| 3,655,089 | 4/1972 | Tower | 220/356 |
| 3,999,677 | 12/1976 | Oberkircher | 220/355 |
| 4,111,329 | 9/1978 | Lampman . | |
| 4,165,020 | 8/1979 | Hoselton . | |
| 4,204,609 | 5/1980 | Kuhn . | |
| 4,296,871 | 10/1981 | Andersson . | |
| 4,420,093 | 12/1983 | Von Holdt | 206/508 |
| 4,700,842 | 10/1987 | Grusin . | |
| 4,733,790 | 3/1988 | Stein | 220/23.83 |
| 4,844,263 | 7/1989 | Hadtke . | |
| 5,038,937 | 8/1991 | DiSesa, Jr. . | |
| 5,184,745 | 2/1993 | Havens et al. | 220/23.83 |
| 5,259,526 | 11/1993 | Stolzman | 220/355 |
| 5,261,554 | 11/1993 | Forbes | 220/356 |
| 5,353,946 | 10/1994 | Behrend | 220/355 |
| 5,409,126 | 4/1995 | DeMars | 220/23.86 |

FOREIGN PATENT DOCUMENTS

| | | | |
|---|---|---|---|
| 1168626 | 6/1984 | Canada . | |
| 404239453 | 8/1992 | Japan | 220/212 |
| 650969 | 3/1951 | United Kingdom | 206/501 |

*Primary Examiner*—Stephen J. Castellano
*Attorney, Agent, or Firm*—Quirk & Tratos

[57] ABSTRACT

A nestable and stackable storage unit including a lid and container is disclosed. The container comprises a base having an upwardly extending wall. The lid is a substantially planar member having top and bottom surfaces and peripheral edge. The lid can be connected to the top of container by pressing a rim located on the wall into a first groove located on the bottom surface of the lid. The lid can be connected to the bottom of the container by pressing a lip located on the base of the container into a second groove located on the bottom surface of the lid. The units can be stored by locating each lid on the base of the container, and nesting the units within one another. Each lid includes a ridge and recess on its top surface for allowing stacking of the same or different size containers upon one another.

6 Claims, 5 Drawing Sheets

NESTABLE AND STACKABLE STORAGE UNIT

FIELD OF THE INVENTION

The present invention relates to a storage unit comprising a container and lid. In particular, the present invention relates to containers which are stackable upon one another when a lid is connected to a top surface thereof, and which are nestable in one another when the lid is connected to a bottom surface thereof.

BACKGROUND OF THE INVENTION

Numerous containers are available for storing items. In particular, many containers have been developed for household use, primarily for storing food items. These containers come in a wide variety of colors and sizes, and normally include a storage area accessible by an opening which can be sealed or closed off with a lid. A number of these containers are normally found in each household.

Users of currently available containers have discovered that these containers have several significant drawbacks. First, owners of these containers encounter difficulties in storing them when not in use. Most commonly, the containers and lids are thrown haphazardly into a cabinet or drawer. It is difficult, however, to find a matching lid and container for use when the containers are stored in this manner.

Some users prevent separation of lids and containers during storage by attaching the lids over the openings of each container. Storage of containers in this fashion requires a tremendous amount of storage space, not commonly available in every household, however.

Furthermore, many containers are not readily stackable. Users often wish to stack one or more containers during use. For example, a user may stack several full containers upon one another in a refrigerator or freezer to conserve space.

This stacking process is often difficult with present containers for two reasons. First, the top surface of the lids of the containers and the bottom surface of the containers are not compatible in size or structure for arranging the containers upon one another in a stable fashion. Even when container/lid compatibility exists for stacking, however, it normally exists only as to containers of the same dimension. Users often wish to stack containers which are of differing sizes.

Currently, no containers exist which are designed for easy storage and stacking with their lids.

SUMMARY OF THE INVENTION

In accordance with the present invention there is provided a nestable and stackable storage unit. In general, the storage unit comprises a container and a lid.

The container comprises a base having an upwardly extending wall connected thereto. The container is preferably cylindrical in shape, and includes an open top end. The lid is a generally planar member, circular in shape when the container is cylindrical in shape, for location on the container.

The lid of a given storage unit is connectable to the top end of its corresponding container. In particular, a rim or lip extends upwardly from the top end of the wall of the container for engagement with a groove on a bottom surface of the lid. When the lid is located over the top end of the container, the opening in the top of the container is effectively closed.

The lid is also connectable to the bottom of the container for storage of the container and lid without the two items becoming separated from one another. A lip extends downwardly from the base of the container for engagement with a second groove in the lid for this purpose. The second groove in the lid is located radially inwardly of the first groove on the bottom surface of the lid. When the lids are connected to the bottom of the containers, containers of different sizes are nestable in one another for storage.

When each lid is located on the top of its container, other containers of the same size are stackable upon one another. In particular, a circumferential ridge extends upwardly from the top of the lid near the outer edge thereof. The ridge on the lid surrounds and engages the downwardly extending lip on the base of a container stacked upon it. In this fashion, each stacked container is effectively retained on the lid below it.

Further, containers can be stacked upon one another in tiered fashion, with the largest on the bottom and smallest on top. In particular, each lid includes a centrally located recessed portion for accepting the downwardly extending lip on the base of a smaller container.

Further objects, features, and advantages of the present invention will become apparent from the detailed description of the drawings which follows, when considered with the attached figures.

DETAILED DESCRIPTION OF THE PREFERRED EMBODIMENT

Figure 1:
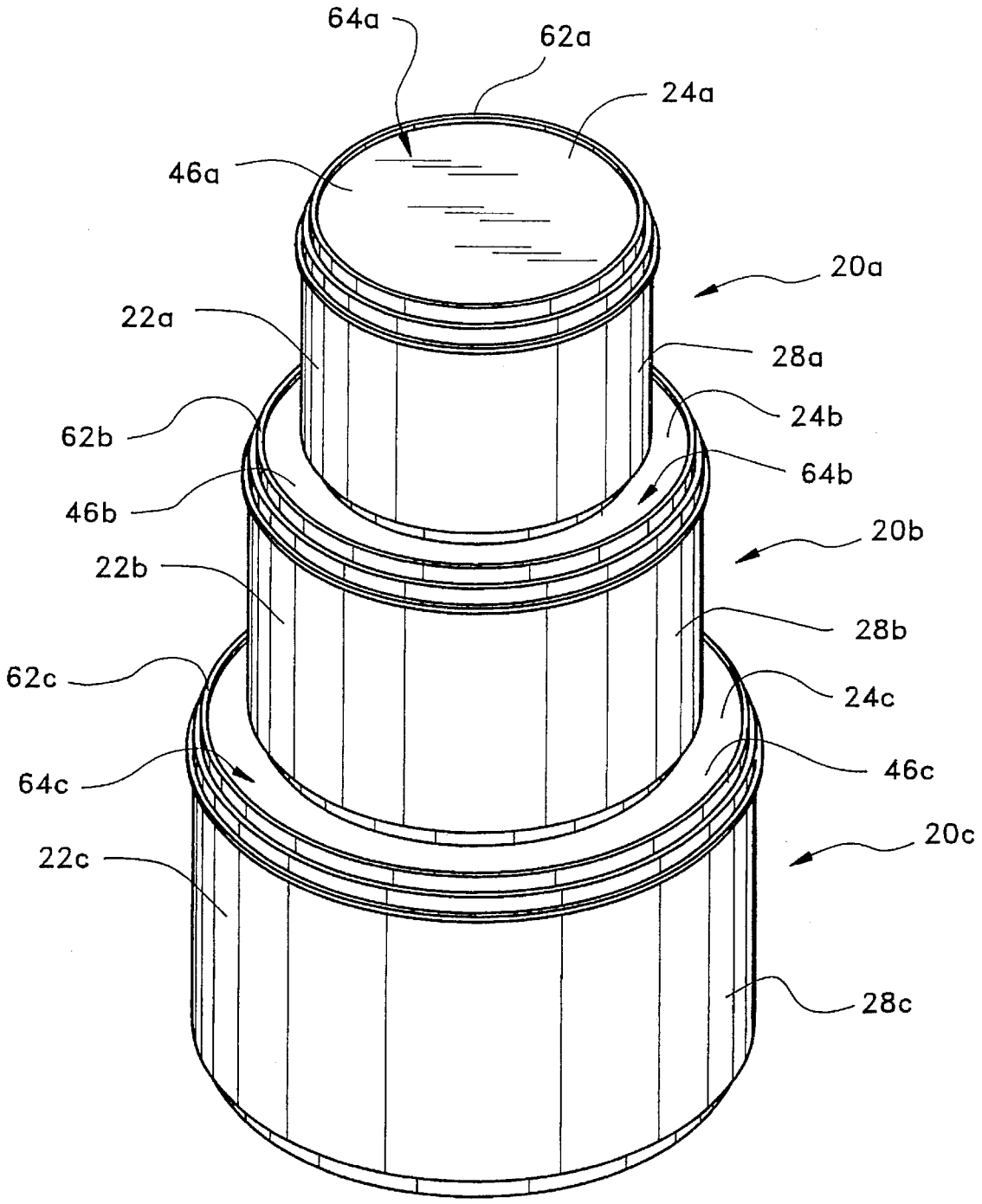
FIG. 1 is a perspective view illustrating three storage units of the present invention stacked upon one another.

FIG. 1 illustrates three storage units 20*a,b,c* of the present invention stacked upon one another. In general, each storage unit 20*a,b,c* comprises a container 22*a,b,c* and a lid 24*a,b,c*.

Figure 2:
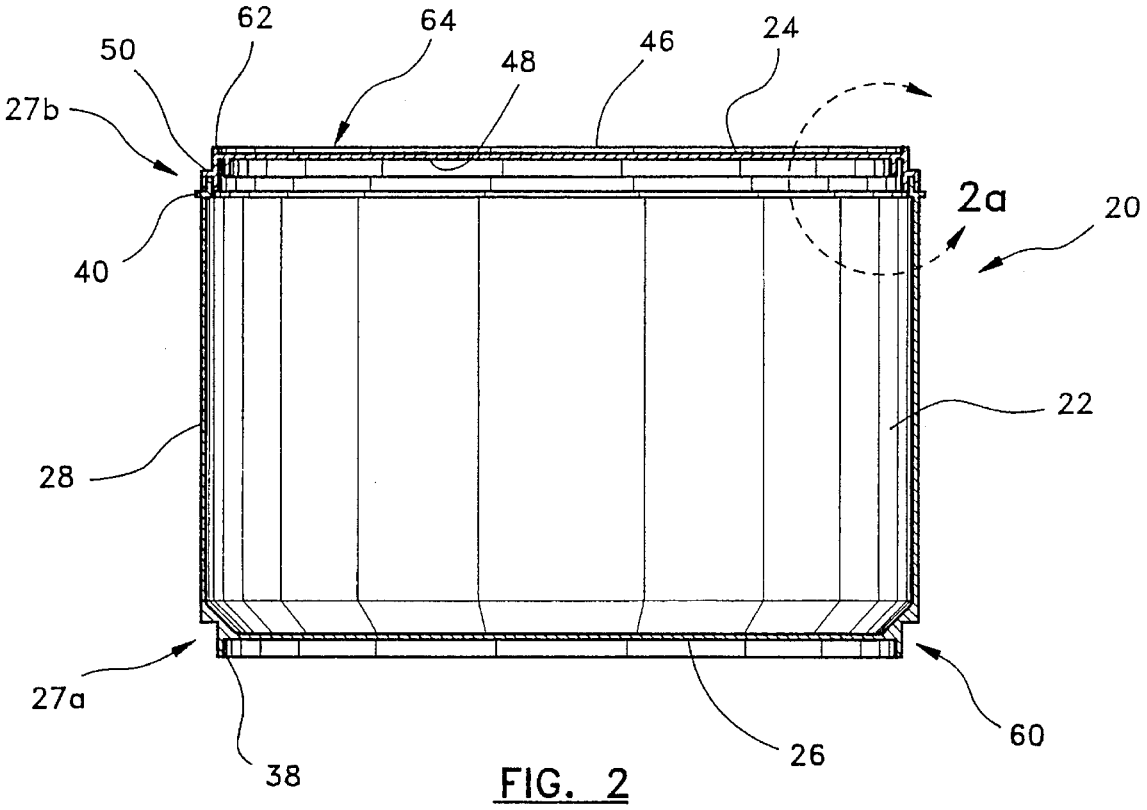
FIG. 2 is a cross-sectional side view of a storage unit of the present invention illustrating a lid connected to a top portion of a container.
Figure 4:
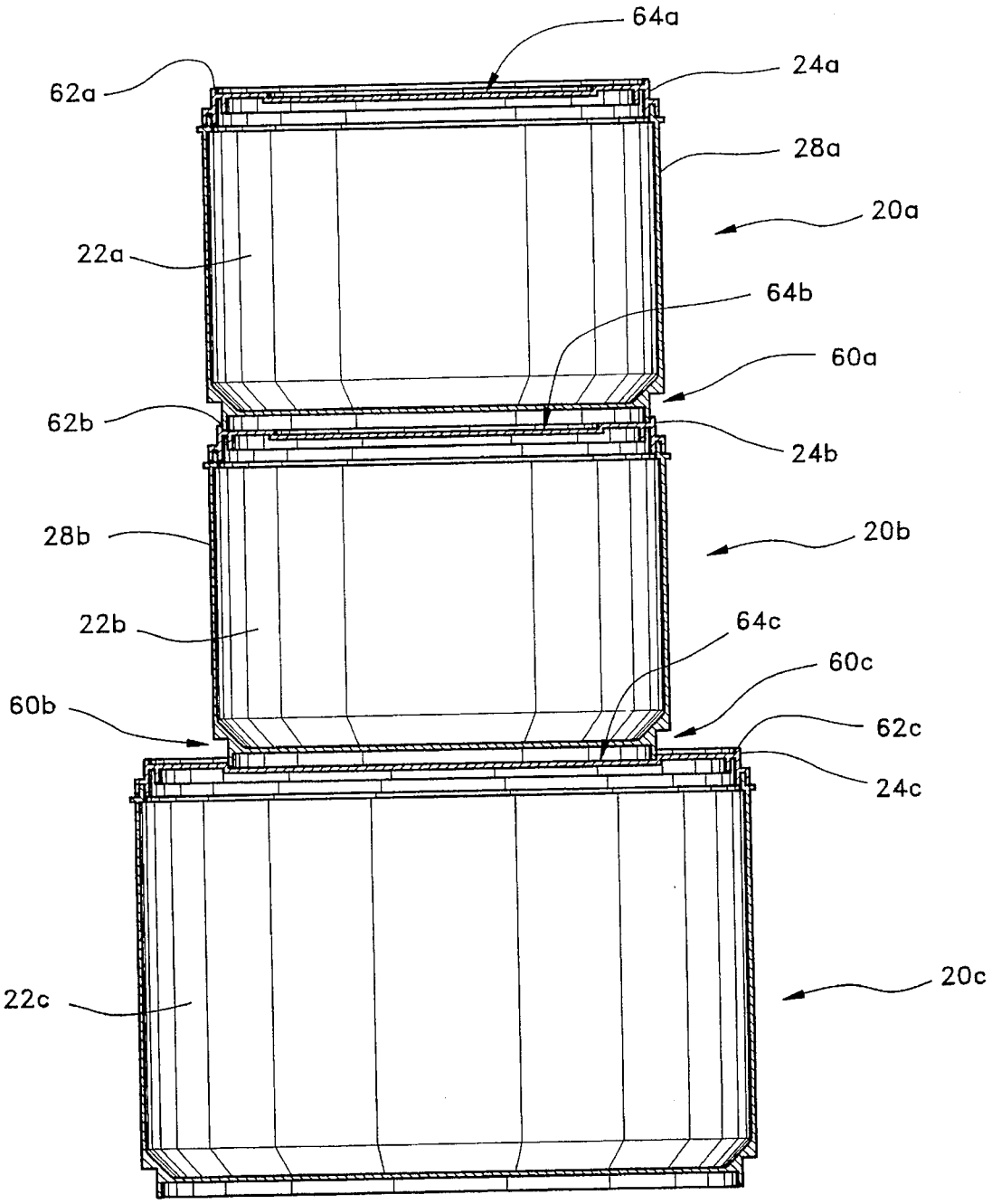
FIG. 4 is a cross-sectional side view illustrating a number of storage units of the present invention stacked upon one another.
Figure 5:
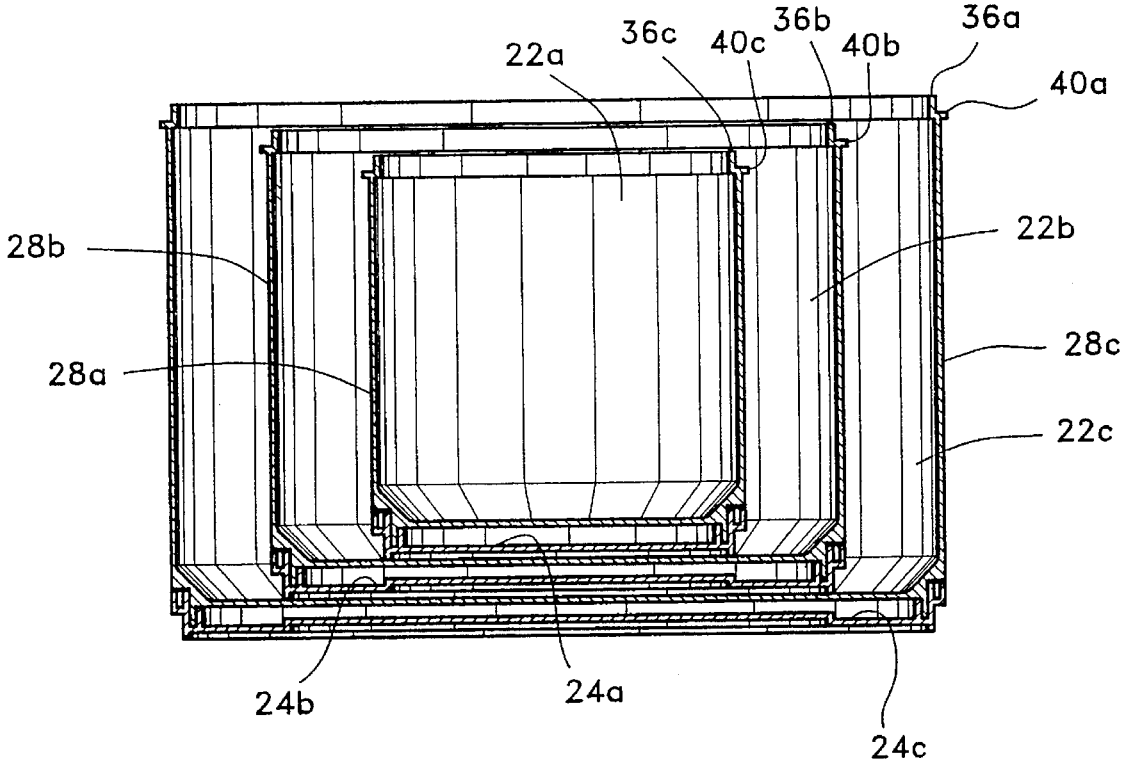
FIG. 5 is a cross-sectional side view of the present invention illustrating a number of storage units of the present invention nested in one another.

As shown in FIG. 2 (the following description is of a single unit comprising a single container and lid, but applies equally to each and all of the units illustrated in FIGS. 1, 4 and 5), the container 22 includes a base or bottom surface 26, and a side wall 28 (indicated separately as 28*a,b,c* in FIG. 1 and 4) extending upwardly from the base. The base 26 is located at a bottom or end portion 27*a* of the container 22. An opening 30 is located in the container at a top or top end portion 27*b*, the opening preferably being equal in size to the space within the perimeter of the wall 28.

The container 22 is preferably made of plastic, although it can be made of glass, metal, ceramic, or other materials. When made of plastic, the base 26 and wall 28 are preferably formed integrally in a molding or extrusion process. The container 22 illustrated is cylindrical in shape, the base 26 and outer perimeter of the wall 28 being circular. The container 22 may have any variety of shapes, however, such as triangular, oval, square, rectangular, hexagonal or the like. The container 22 may have a wide variety of dimensions, from only a few inches tall and a few inches in diameter to as much as a foot or more tall and/or wide.

As best illustrated in FIGS. 1 & 2, the lid 24 is a substantially planar member having a shape conforming to the opening at the top 27*b* of the container 22, and includes a top surface 46*a,b,c*, bottom surface 48, and an outer or peripheral edge 50. When the periphery of the wall 28 is circular in shape, the lid 24 is also circular in shape.

The lid 24 is preferably made of plastic or a similar durable and flexible material, and has an outer dimension substantially the same as the outer dimension of the container 22, as described in more detail below.

The storage unit 20 includes means for securing the lid 24 to the wall 28 of the container for closing the opening 30 at the top 27*b* thereof. Further, the unit 20 includes means for securing the lid 24 to the bottom 27*a* of the container at the base 26 thereof.

Figure 2A:
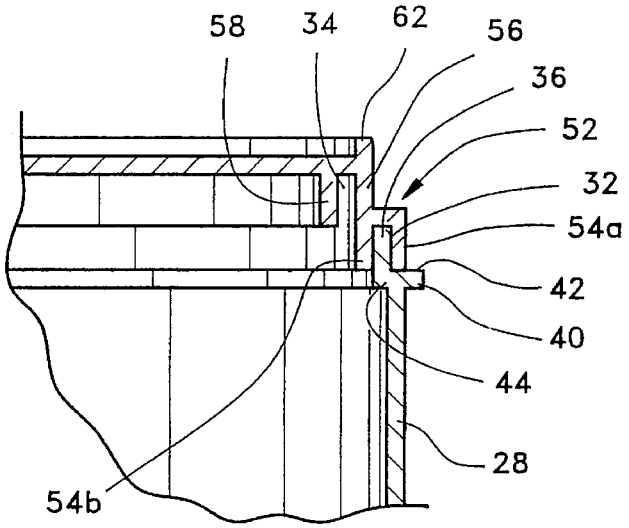
FIG. 2*a* a partial enlarged view of the portion of FIG. 2 as indicated therein.

As seen in FIG. 2*a*, the lid 24 can be secured over the opening 30 at the top 27*b* of the container 22 by an interengaging groove 32 in the lid and a mated rim or lip 36 (more clearly illustrated in FIG. 5 as elements 36*a,b,c* located on the wall 28 of the container.

The rim 36 extends upwardly from the wall 28 at the free edge of the wall located opposite its connection to the base 26, and is located peripherally inwardly from the wall a short distance. In particular, a flat stop 40 (see also FIG. 5, the stops labelled 40*a,b,c* therein) is located on the end or edge of wall 28 opposite the base 26. The stop 40 is about 2–3 times the width of the wall thickness and is centered on the wall 28, having a first end portion 42 located peripherally outside of the wall 28, and a second end portion 44 located inside of the wall 28. The rim 36 extends upwardly from the first end portion 42 of the stop 40 about 0.1–0.5 inches.

The groove 32 for engagement with the rim 36 is formed by two parallel concentric flanges 54*a,b* which extend around the periphery of the lid. In particular, an "h"-shaped member 52 having two flanges 54*a,b* and elongate neck 56 extends downwardly from the lid 24. The flanges 54*a,b* are about 0.1–0.5 inches long, and are separated by about 0.05–0.3 inches. The neck 56 is about 0.1–0.4 inches long, and is connected at one end to the lid 24, and to one of the flanges 54*b* at the other. The other flange 54*a* is located peripherally outward of the first.

The gap between the flanges 54*a,b* forms the groove 32 in which the rim 36 on the wall 28 of the container 22 in inserted. For this reason, the groove 32 has a width and depth dimension to frictionally engage the rim 36. Further, as illustrated in FIG. 2, the outer flange 54*a* engages the stop 40 on the wall 28 when the lid 24 is located on the container.

The lid 24 can also be connected to at the bottom 27*a* of the container 22. In particular, a lip 38 is located on the container for engagement with a second groove 34 located on the lid 24.

The lip 38 extends downwardly from the base 26 a distance of about 0.1–0.5 inches, extending peripherally about the base 26 a distance of about 0.2–0.7 inches radially inwardly of the outer surface of the wall 28.

The second groove 34 comprises a space between the aligned elongate neck 56 and flange 54*b* of "h"-shaped member 52, and a downwardly extending tab 58 located radially inwardly therefrom. The tab 58 is located inwardly about 0.05–0.3 inches from the neck 56/flange 54*a*, and extends downwardly from the bottom surface 48 of the lid 24 about 0.1–0.5 inches. In any case, the groove 34 is wide and deep enough to accept at least a portion of the lip 38 extending from the container 22.

Figure 3:
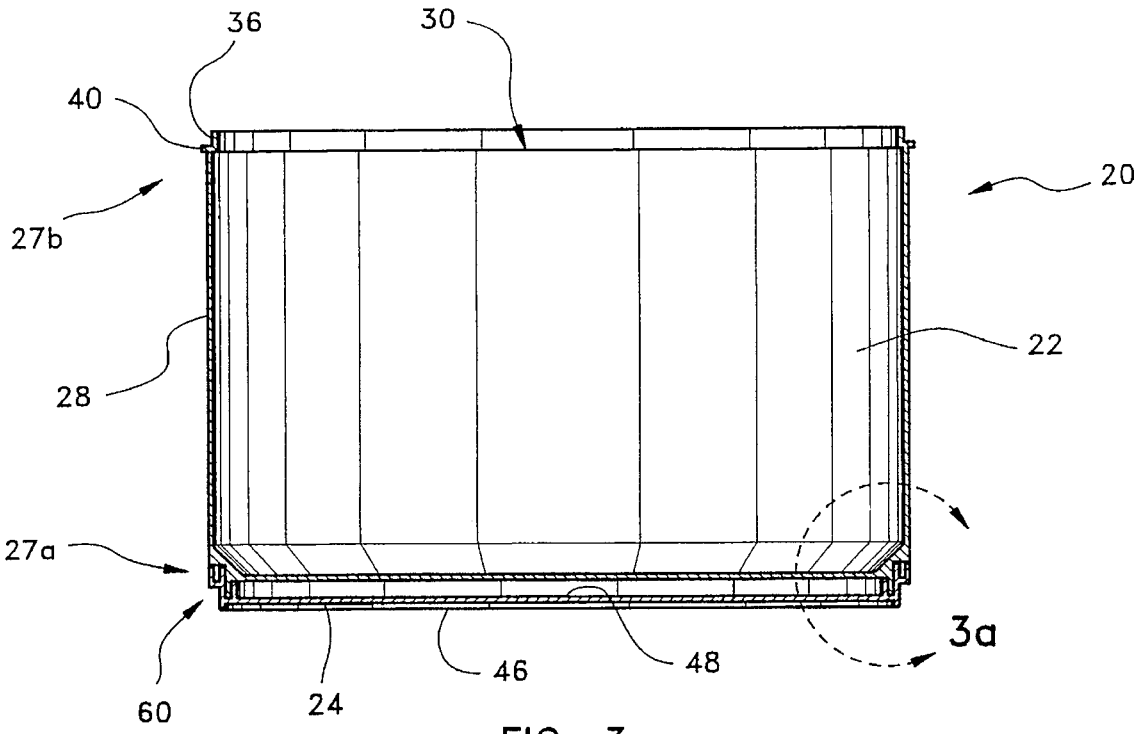
FIG. 3 is a cross-sectional side view of the storage unit of FIG. 2, illustrating the lid on the bottom of the container.
Figure 3A:
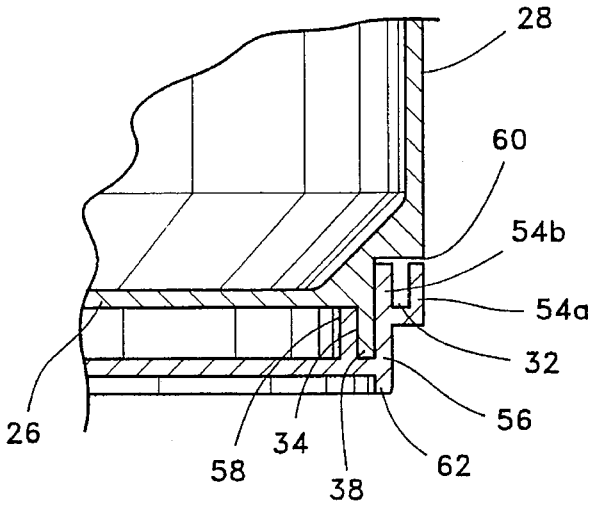
FIG. 3*a* is a partial enlarged view of the portion of FIG. 3 as indicated therein.

As illustrated in FIGS. 2 and 3, a notch 60*a,b,c* is located in the outer peripheral portion of the container 22 at the intersection of the base 26 and wall 28. The notch 60 is about 0.25 –1.5 inches tall, and 0.1–1.0 inches deep (in the radial direction). The notch 60 accepts the flanges 54*a,b* when the lid 24 is located on the bottom surface 48 of the container. In particular, the notch 60 is wide enough to prevent the flange 54*a* from extending peripherally beyond the wall 28.

As illustrated in FIGS. 1 and 2, an upwardly extending tab or ridge 62*a,b,c* is located along the edge 50 on the top surface 46 of the lid 24. The ridge 62 is about 0.1–0.5 inches tall. As described in more detail below, this ridge 62 is arranged to cooperate with the downwardly extending lip 38 on the base 26 as illustrated in FIG. 2.

Use of the storage unit(s) of the present invention will now be described in conjunction with FIGS. 1–3. As illustrated in FIG. 1, a user can stack the units 20*a,b,c* upon one another with the lids 24*a,b,c* connected to the top of the container 22*a,b,c*. In particular, a user may locate food or other goods within the container 22*a,b,c*, placing the lid 24*a,b,c* over the opening thereof, to retain the contents of the container 22*a,b,c* therein.

As best illustrated in FIG. 2, when the lid 24 is located on the top 27*b* of the container 22, the rim 36 on the wall 28 extends upwardly into the first groove 32. Most importantly, when the lid 24 is made of a flexible material such as plastic, the flanges 54*a,b* of the "h"-shaped member 52 thereon (which define the groove 32 therebetween) are preferably separated by a slightly smaller distance than the width of the rim 36. The rim 36 presses the flanges 54*a,b* outwardly as the lid 24 is located over the container 22, forming a tight fit between the lid and container.

The user engages the lid 24 and the container 22 by aligning the groove 32 in the lid over the rim 36 on the wall 28 of the container. The user then presses downwardly on the lid 24, pressing the groove 32 over the rim 36 on the container.

As illustrated in FIG. 4 by the top two containers 22*a,b*, a user can stack units 20*a,b* of the same size upon one another when each container 22*a,b* has its corresponding lid 24*a,b* connected to the bottom thereof. The user stacks containers by placing the base 26 of the second container on the top surface of the lid of a first container, and so on. As illustrated, the lip 38 extending downwardly from the base 26 of the container 22*a* fits slightly within the ridge 62 extending upwardly from the lid 24*b* of the other container, retaining the two units 20*a,b* in position on one another.

The user can also nest units of different sizes within one another, as illustrated in FIG. 5. Most importantly, the containers 22*a,b,c* can be nested within one another with their lids 24*a,b,c* connected to the bottom 27*a* thereof.

The user locates the lid 24*a,b,c* of each container 22*a,b,c* on the top 27*b* of the container for nesting. In particular, the user obtains the lid 24*a,b,c* (by removing it from the bottom 27*a* of the container if necessary) and aligns the second groove 34 thereon with the lip 38 extending downwardly from the base 26. The user presses the lid 24*a,b,c* and container 22*a,b,c* towards one another to force the lip 38 into the groove 34 in the lid. The user then locates the units

20*a,b,c* within one another, smallest within the next largest and so on.

As a further aspect of the present invention, and as illustrated in FIGS. 1 and 4, storage units 20*a,b,c* of different sizes can be stacked in tiered fashion upon one another. The lid 24*a,b,c* of each unit 20*a,b,c* preferably includes a recessed central section 64*a,b,c* on the top surface 46 for this purpose.

The recess 64 is preferably an indentation in the lid 24*a,b,c*, either formed by removing a portion of the material comprising the lid in a particular area, or by offsetting a portion of the lid with respect to the remainder of the lid.

Preferably, the recess 64 is of a size and shape which matches the size and shape of the lip 38 of another container 22*a,b,c*. In this fashion, a container 22*a,b,c* may be located on the top surface 46*a,b,c* of the lid 24*a,b,c* in a secure fashion, with the lip 38 thereof extending downwardly into the recess 64*a,b,c* in the lid. Each lid 24*a,b,c* may have a recess 64*a,b,c* of a different size. For example, if a user has three containers 22*a,b,c* of different sizes to be stacked upon one another, the lids 24*a,b,c* for use therewith have recesses 64*a,b,c* of a different size to allow the next sized container to be placed on top of it, as illustrated in FIG. 1.

Again referring to the container and lids generally, while the means for securing the lid 24 to the top and bottom 27*a,b* of the container 22 have been described as a separate rim and lip 36,38 and grooves 32,34, the means for securing may have many other configurations. For example, the means for securing may comprise a single groove located on the bottom surface 48 of the lid 24 for engagement with a lip on the base 26 and a rim on the wall 28 of the container. Alternatively, the grooves 32,34 in the lid 24 may be located on opposite sides 46,48 thereof. For example, the groove 32 for engagement with the rim 36 may be located on the top surface 46 of the lid 24, and the second groove 34 for connection with the lip 38 may be located on the bottom surface 48 of the lid. When arranged in this fashion, the grooves 32,34 may be located directly above and below one another, or may be offset.

In another embodiment, the lip or rim on the top of the container 20 and the lip or rim on the bottom of the container are in alignment above one another. In that instance, the rim on the top and the lip on the bottom of the container have the same dimension and are readily engageable by a single groove in the lid 24.

As a further aspect of the present invention, each container 22 and matching lid 24 may be color coded so as to further enable the user of the units 20 to locate and match containers and lids. Each lid 24 and matching container 22 may be molded of the same color plastic, with each unit molded in a different color from the other units. Alternatively, color stripes, stickers, tabs, dots or similar markings may simply be located on each lid and matching container.

Each lid 24 may also include a thumb tab, indentation, notch or (not shown) or similar user finger, thumb, or hand-engaging member for rendering removal of the lid 24 from the container 22 less difficult. In particular, the lid 24 is firmly located on a container. To remove the lid 24, the user must pry a portion of the peripheral edge of the lid upwardly from the container. When the lid does not overhang the outer periphery of the container by a significant distance, this is a difficult task. A tab, or other outwardly extending member, is preferably located on a portion of the peripheral edge 50 of the lid 24. The tab is size to allow a user to grasp it and pull upwardly to separate the lid 24 from the container 22. Alternately, an indentation or other member may be located on or in the top surface of the lid 24 for engagement by the user for pulling the lid off of the container.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A nestable and stackable storage unit comprising:

a container comprising a base with an upwardly extending wall having a rim extending upwardly therefrom and located inwardly thereof and a lip extending downwardly from said base and located inwardly of said wall;

a substantially planar lid, having a top surface and a bottom surface, said lid having a member extending downwardly from such lid below said bottom surface, said member including inward and outward flanges defining a first groove therebetween for engagement with said rim on said container, said member oriented on said lid such that when said first groove engages said rim, said outward flange is not located outwardly of said upwardly extending wall, a tab extending downwardly from said lid below said bottom surface, said member and tab defining a second groove therbetween for engagement with said lip on said base, said lip on said base located inwardly of said upwardly extending wall a sufficient distance such that when said second groove engages said lip, said member on said lip does not extend outwardly of said upwardly extending wall.

2. The storage unit of claim 1, further including a central recessed portion in a top surface of said lid for stacking a container thereon.

3. The storage unit of claim 1, wherein said member extends downwardly from said lid a greater distance than said tab.

4. The storage unit of claim 1, wherein said inward flange extends downwardly from said outer edge of said lid and said outward flange extends downwardly from said inward flange and is located outwardly therefrom and outwardly of said outer edge of said lid.

5. The storage unit of claim 1, wherein said member on said lid is "h"-shaped.

6. The storage unit of claim 1, wherein said lid is circular and has a first diameter and said container is cylindrical and has a second diameter, the first and second diameters being equal.

* * * * *